United States Patent [19]

Buchar

[11] Patent Number: 4,618,248

[45] Date of Patent: Oct. 21, 1986

[54] TEST PATCH GENERATION UTILIZING SYSTEM SCAN OPTICS

[75] Inventor: Wayne A. Buchar, Rochester, N.Y.

[73] Assignee: Xerox Corporation, Stamford, Conn.

[21] Appl. No.: 713,530

[22] Filed: Mar. 18, 1985

[51] Int. Cl.[4] ..... G03G 15/00

[52] U.S. Cl. ..... 355/14 R; 355/14 E; 355/8

[58] Field of Search ..... 355/14 R, 14 D, 14 E, 355/8

[56] References Cited

U.S. PATENT DOCUMENTS

| | | | |
|---|---|---|---|
| 4,178,095 | 12/1979 | Champion et al. | 355/14 R |
| 4,215,930 | 8/1980 | Miyakawa et al. | 355/14 E X |
| 4,277,162 | 7/1981 | Kasahara et al. | 355/14 D X |
| 4,306,804 | 12/1981 | Sakamoto et al. | 355/14 E |
| 4,313,671 | 2/1982 | Kuru | 355/14 D |
| 4,318,610 | 3/1982 | Grace | 355/14 D |
| 4,348,099 | 9/1982 | Fantozzi | 355/14 E |
| 4,377,338 | 3/1983 | Ernst | 355/14 D |

*Primary Examiner*—Arthur T. Grimley
*Assistant Examiner*—J. Pendergrass

[57] ABSTRACT

An electrophotographic printing machine utilizing an optical illumination and scanning system which, besides performing the conventional document reproducing function, is adapted to operate in a machine test mode. In the test mode, target strips of varying density affixed to the bottom of a platen are projected as test patch images onto the surface of a photoreceptor. The voltage levels of these patches are then measured and used to adjust variable parameters to maintain optimum operation.

The optical system, when operating in the test mode, sequentially and selectively illuminates various of the test patches while control means selectively varies the illumination levels.

2 Claims, 12 Drawing Figures

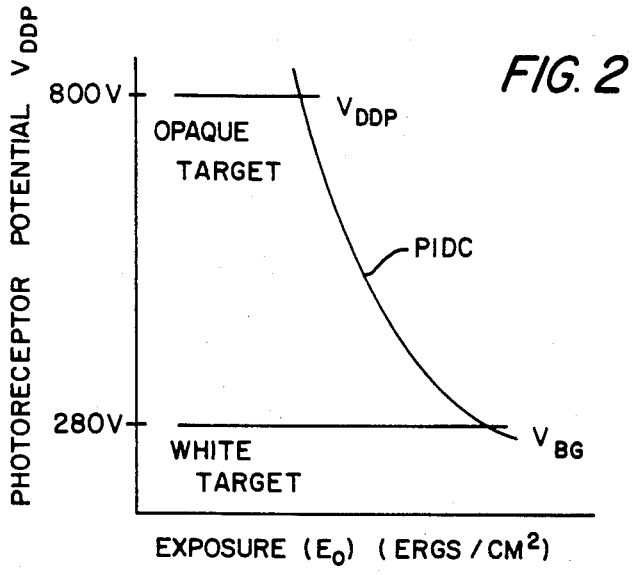
FIG. 2
FIG. 5
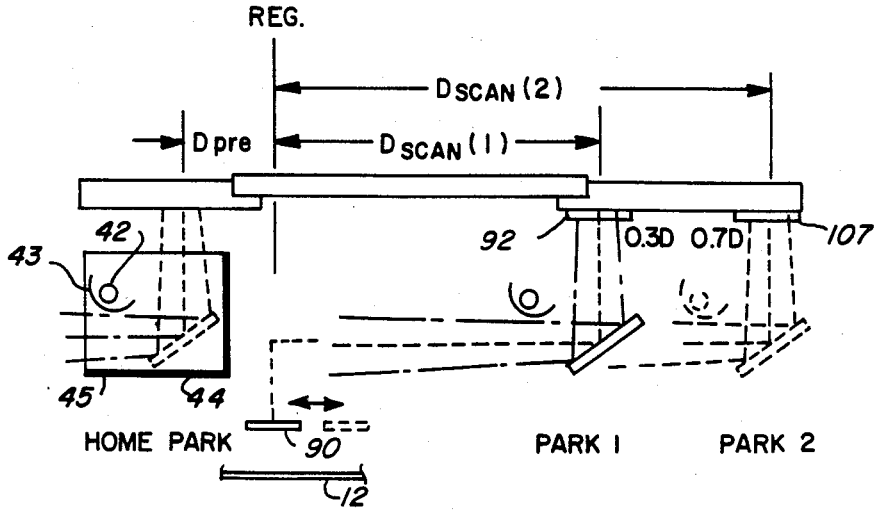

TEST PATCH GENERATION UTILIZING SYSTEM SCAN OPTICS

This invention relates to electrophotographic printing machines and, more particularly, to a document illumination and scanning system which is adapted for use in a first test mode of operation and for a second normal scan mode of operation.

In electrophotographic devices, such as a xerographic copier or printer, a photoconductive surface is charged to a substantially uniform potential. The charged portion of the photoconductive surface is exposed to a light image of an original document being reproduced, forming an electrostatic latent image at the photoconductive surface corresponding to the informational areas contained within the original document. The electrostatic latent image is subsequently developed by bringing a developer mixture into contact therewith. The developed image is subsequently transferred to an output copy sheet. The powder image on the output sheet is then heated to permanently affix it to the sheet in the image configuration.

The optical system for exposing the document and projecting an image onto the photoconductive surface typically takes one of two forms; either a scanning or a flash mechanism. This invention is concerned with an optical scanning system which has been adapted to provide the normal document scan and illumination associated with the reproduction process while providing a second mode of operation during certain system test and control procedures. These test and control procedures are required to be performed on electrophotographic machines to identify and compensate for variable factors which affect machine performance. These factors include aging of the developer mixture, changes in environment, variations in the dark development potential, and residual voltage of the photoconductor or photoreceptor surface, a thinning of the photoreceptor surface due to abrasion, photoreceptor fatigue, exposure lamp illumination variations, and changes in the toner material concentration due to consumption. These variations, singly or cumulatively, have adverse affects on output copy quality that must be identified and compensated for on a continuous basis.

Various control schemes are known to compensate for the variable factors listed above. These schemes involve adjustment of basic control parameters; viz. adjusting the current of the device used to deposit the charge on the photoconductive surface, adjusting the bias applied to the development unit, varying the concentration of the toner mixture and changing the exposure level. All of these adjustments require the formation of one or more test patches of a specified dentsity on the photoreceptor which can be sequentially measured and compared with related parameter values. A control system generally incorporating logic elements adjusts system parameters as necessary to obtain optimum values for the particular machine.

Test patch formation has, in the prior art, been accomplished by three different methods exemplified by the disclosure of the following references. In U.S. Pat. No. 4,318,610, the test patch at a photoreceptor is produced by light sources separate from the optical system and positioned at a designated position overlying the photoreceptor. U.S. Pat. No. 4,306,804 discloses a scanning system in FIG. 5 which, at the start of a document scan, exposes a reference target affixed to the bottom of the platen onto the photoreceptor. In U.S. Pat. No. 4,348,099 a reference target is periodically moved (articulated) into the optical path to provide test patches of varying density at the photoreceptor.

These prior art test patch generating techniques have several disadvantages. They either require additional components to be added to the system (U.S. Pat. Nos. 4,318,610 and 4,348,099) thereby increasing the cost and complexity or permit only limited test functions (U.S. Pat. No. 4,306,804).

It would be desirable to provide a test patch generation system which does not require any additional illumination or articulating elements, which utilizes the system optics and which provides a plurality of test reference patches at desired photoreceptor locations which permits measurement and control of all of the variable system parameters.

In accordance with the present invention, there is provided an optical system for an electrophotographic machine which operates in a first, conventional, illumination and scanning mode to expose documents on the surface of a photoreceptor. The optical system is adapted to operate in a second mode of operation associated with machine parameter testing, whereby the optical system forms up to four varying density test patches on a photoreceptor surface. The charge levels at these patches are available for voltage sensing, comparison with present values and subsequent adjustment of parameter values.

More particularly, the invention relates to an electrophotographic printing machine wherein a document is scanned and an image thereof projected onto a photoreceptor surface, an optical illumination and scanning system adapted to operate in a first and second mode of operation, said system comprising:

a platen for supporting said document, said platen having a at least one target strip 2 of varying density affixed to its bottom surface.

an elongated illumination and scan assembly mounted beneath said platen on a support member movable in a parallel path beneath said platen, means for driving said support members in a first test mode of operation wherein the support member is sequentially movable to a park position coincident with the positioning of an opaque occluder in the optical path, and further including means for selectively altering the illumination when said support member is parked beneath said target strip varying the density level of test patches projected onto the photoreceptor surface, and means for driving said support member in a second document scanning mode of operation wherein the support member is cyclically driven from a start-of-scan to end-of-scan to start-of-scan position with a constant illuminator output.

Other aspects of the present invention will become apparent as the following description proceeds and upon reference to the drawings in which:

FIG. 2 shows PIDC plot of Exposure vs. Photoreceptor Potential;

Figure 4A:
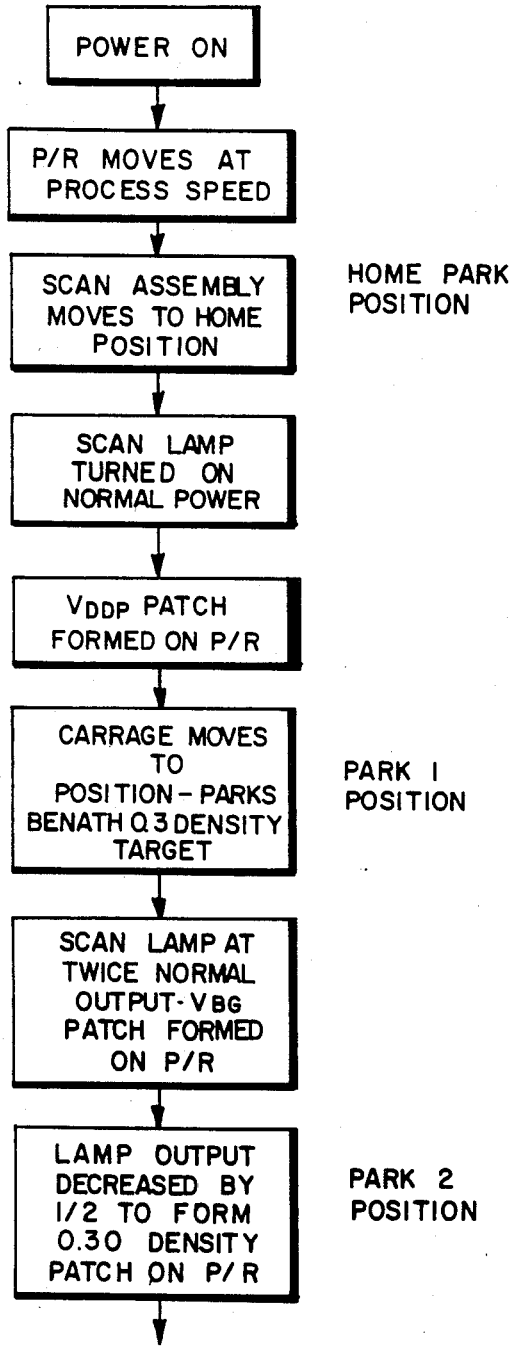
Figure 4B:
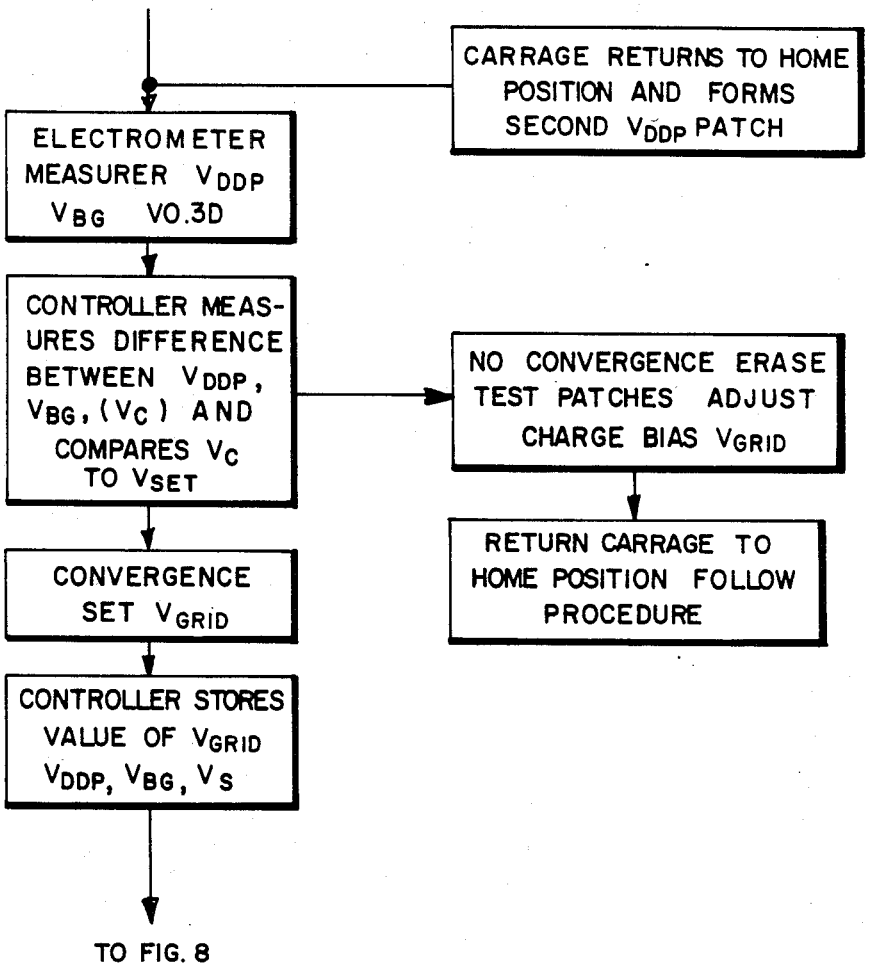
Figure 6:
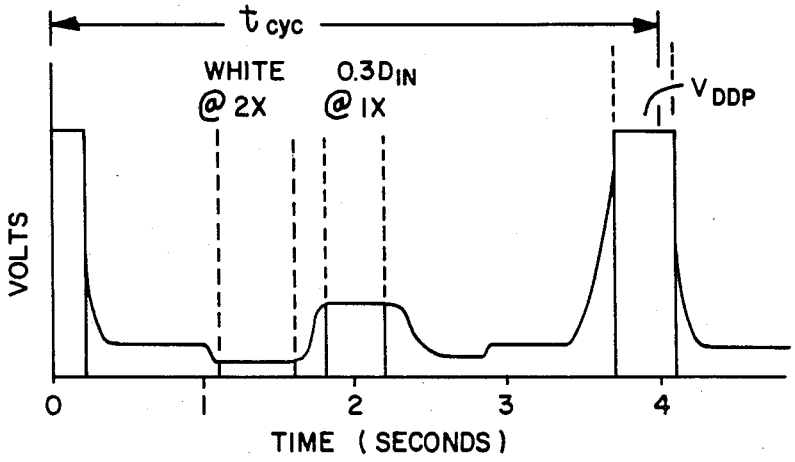
Figure 10:
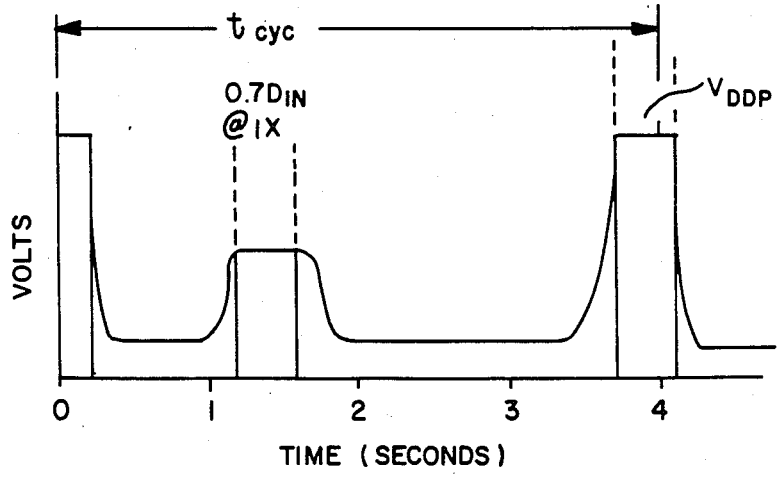
Figure 7:
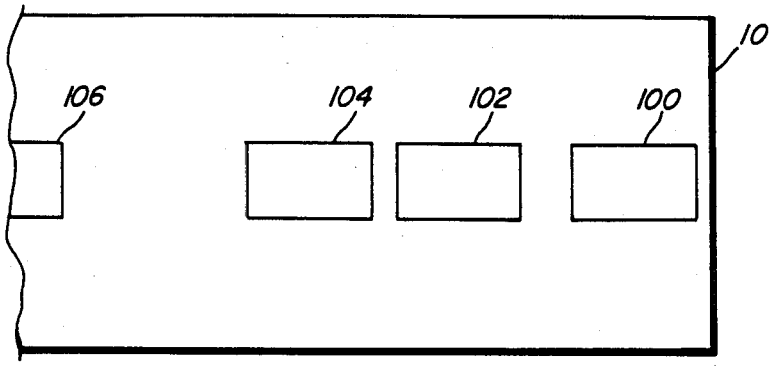
Figure 11:
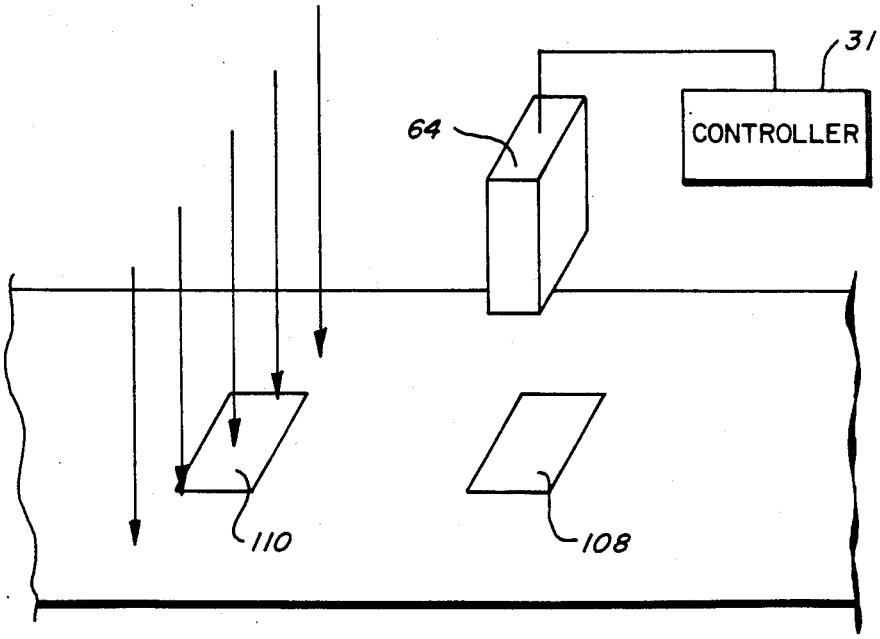
Figure 8:
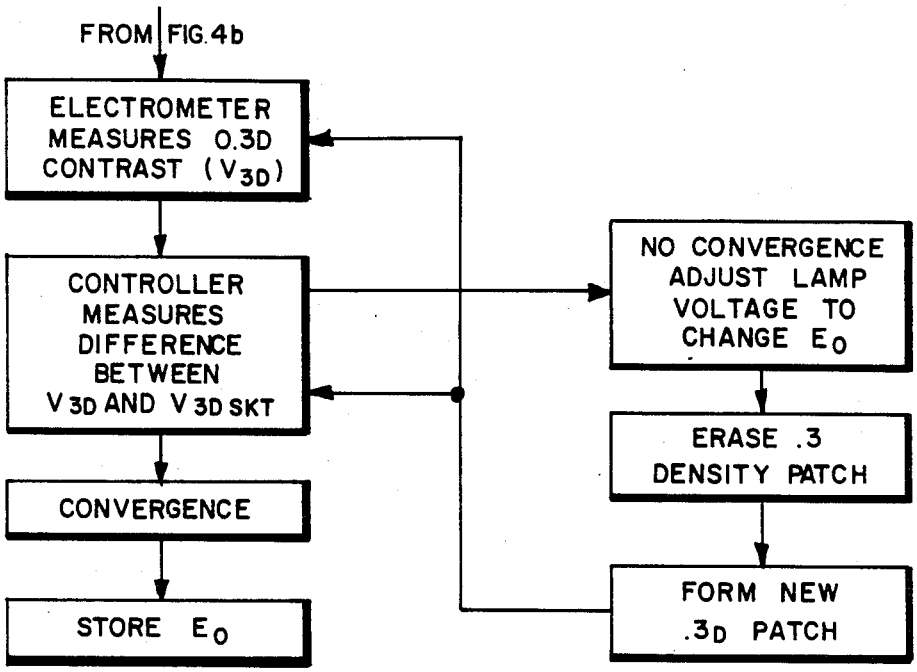
Figure 9:
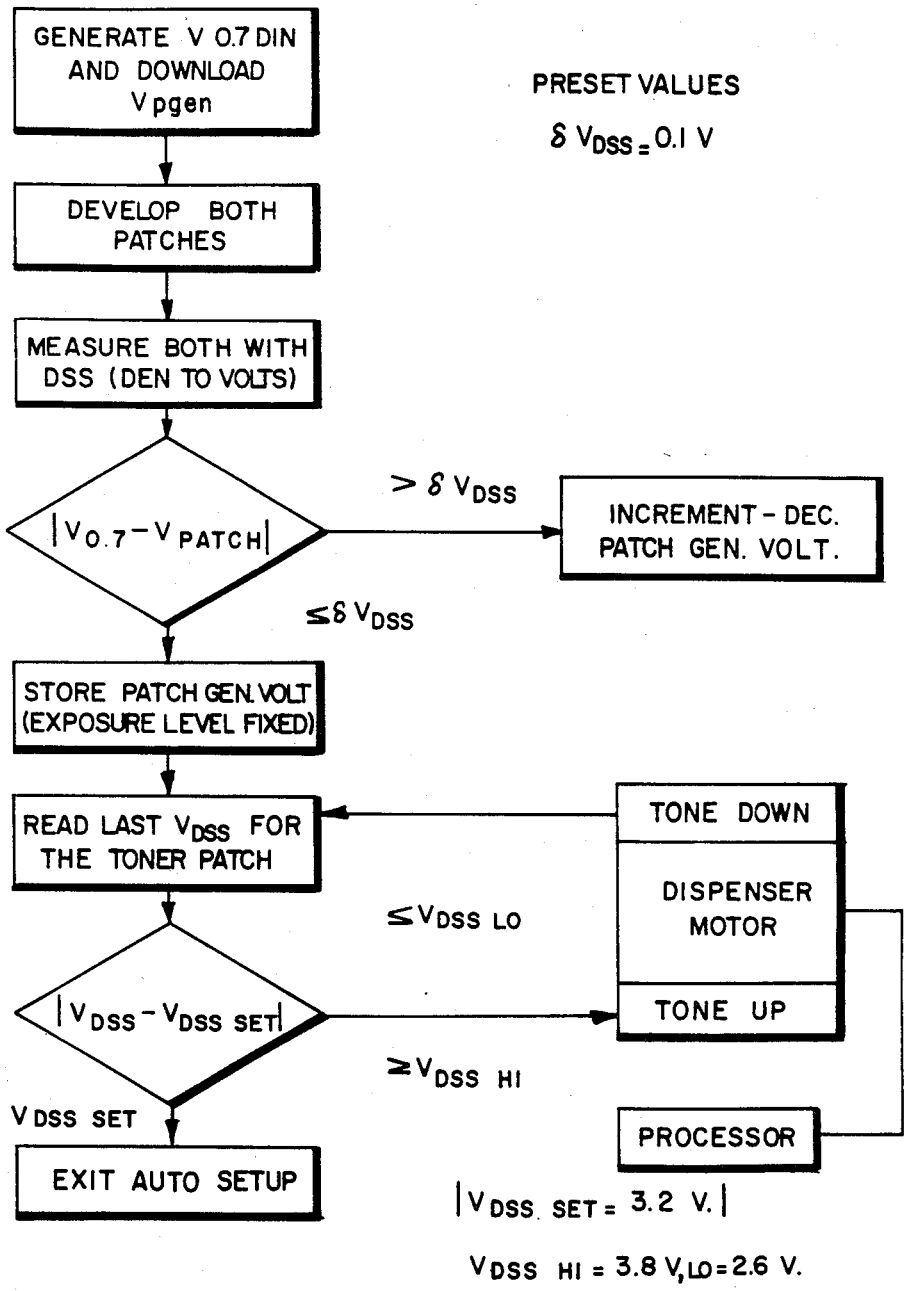

FIGS. 4*a*, 4*b* is a functional flow diagram of the patch generation portion of the automatic setup procedure;

FIG. 5 is a side schematic view of the scan carriage at separate density generating positions;

FIG. 6 is a time vs. voltage plot of the test patch generation sequence;

FIG. 7 is a top view of a portion of the photoreceptor belt having test patches formed thereon;

FIG. 8 is a functional flow diagram of the 0.3D density patch generation;

FIG. 9 is a functional flow diagram showing the exposure convergence sequence;

FIG. 10 is a time vs. voltage plot of the 0.7 density test patch generation;

FIG. 11 is a top view of a portion of the photoreceptor but having 0.7 density patch formed thereon.

Figure 1:
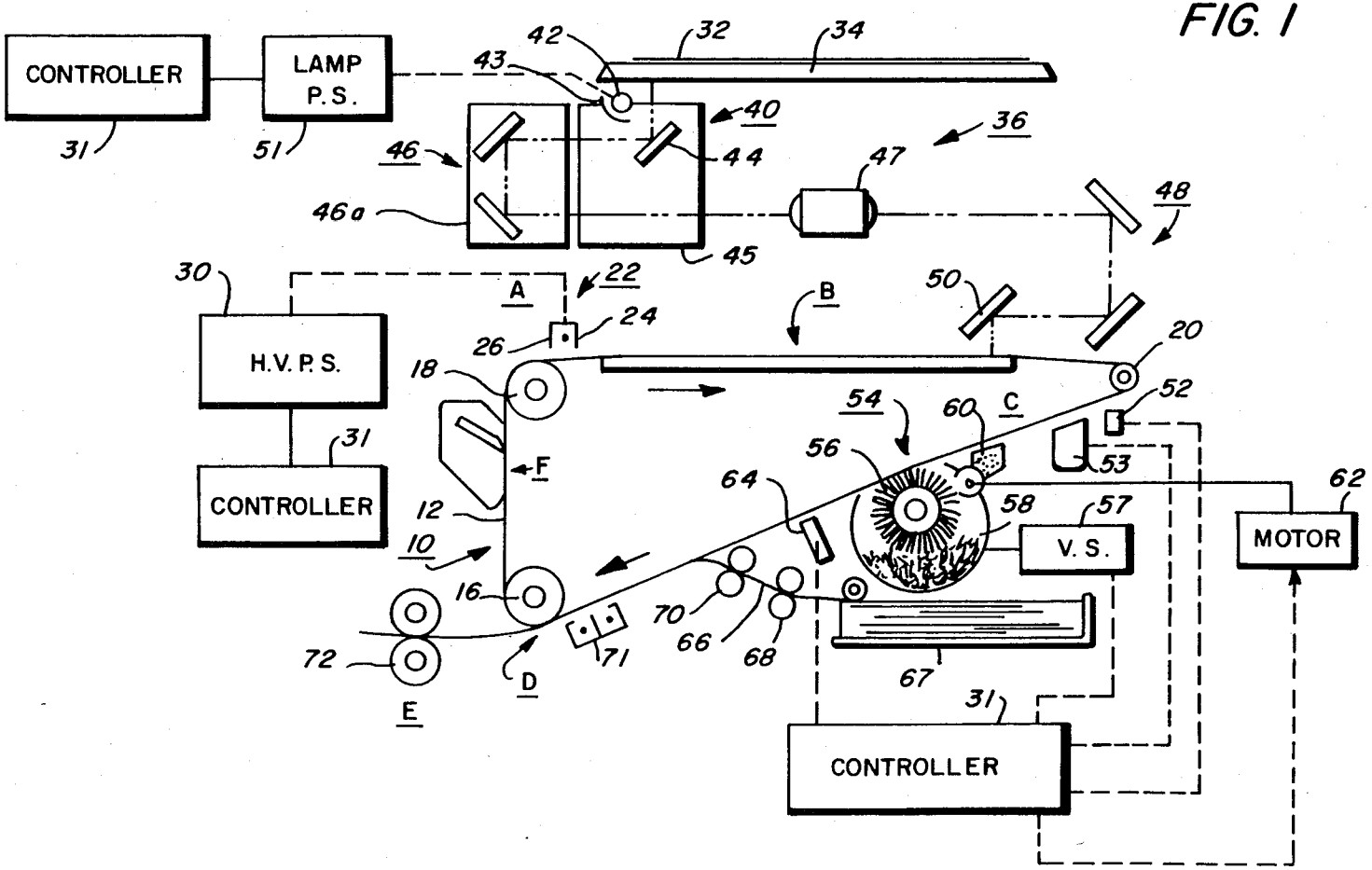
FIG. 1 is a side schematic view of an electrophotographic printing machine incorporating the features of the present invention.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the optical system of the present invention therein. It will become apparent from the following discussion that this optical system is equally well suited for use in a wide variety of electrophotographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine uses a photoreceptor belt 10 having a photoconductive surface 12 formed on a conductive substrate. Preferably, belt 12 has characteristics disclosed in U.S. Pat. No. 4,265,990 whose contents are hereby incorporated by reference. Belt 10 moves in the indicated direction, advancing sequentially through the various xerographic process stations. The belt is entrained about drive roller 16 and tension rollers 18, 20. Roller 16 is driven by conventional motor means, not shown.

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26. A high voltage supply 30 controlled by a portion of controller 31, is connected to shield 26. A change in the output of power supply 30 causes a change in charging current, $I_C$, and consequently, a change in the charge potential applied to surface 12.

As belt 10 continues to advance, the charged portion of surface 12 moves into exposure station B. An original document 32 is positioned, either manually, or by a document feeder mechanism (not shown) on the surface of a transparent platen 34. Optics assembly 36 contains the optical components which, in a normal document reproduction mode, incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath, the platen. Lamp 42 illuminates an incremental line portion of document 32. The reflected image is reflected by scan mirror 44 to corner mirror assembly 46 on a second scan carriage 46A moving at ½ the rate of mirror 44. The document image is projected through lens 47 and reflected by a second corner mirror 48 and belt mirror 50, both moving at a predetermined relationship so as to precess the projected image, while maintaining the required rear conjugate onto surface 12 to form thereon an electrostatic latent image corresponding to the informational areas contained within original document 32. Adjustable illumination power supply 51, controlled by a portion of controller 31, supplies power to lamp 42. The optics assembly 36, besides operating in a document scanning mode, is also used in an automatic setup mode to generate and project four alternating density patches onto the centerline of the belt 10 for purposes to be described more fully below. Positioned between exposure station B and development station C, and adjacent to surface 12, is electrostatic voltmeter 52. Voltmeter 52 preferably is capable of measuring either positive or negative potentials and utilizes ac circuitry requiring no field calibration. Voltmeter 52, in the automatic setup mode, generates a first signal proportional to the dark decay potential $V_O$ on photoconductive surface 12. The dark development potential is the charge at surface 12 after charging and exposure reflected from an opaque object. The voltmeter also generates a second signal proportional to background potential $V_B$, on the photoreceptor surface. The background potential is the charge on the photoreceptor after exposure with light reflected from a white object. Both of the voltmeter output signals are sent to controller 31 through suitable conversion circuitry. Controller 31 operates upon these values, comparing them to values related to a desired output quantity in the controller memory. Adjustments are made by the controller to the charging and development bias voltage and to the illumination power supply in an iterative process described in further detail below:

Referring again to FIG. 1, discrete patch generator 53 is a calibrated LED light source which is energized in one of two modes of operation. In a first mode, operable during the automatic setup mode, a dedicated digital input provides for LED energization at a high fixed level. This mode is used primarily for erasing test patch areas generated during the setup procedures. In a second mode of operation, following the initial system setup, an analog reference input to the generator 53 provides for energization of the LEDs so as to generate a variable light intensity for use in toner control in several contrast modes as described in greater detail below.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material comprising magnetic carrier granules and toner particles into contact with belt 10. Roller 56 is positioned so that the brush of developer material deforms belt 10 in an arc with the belt conforming, at least partially, to the configuration of the developer material. The thickness of the layer of developer material adhering to developer roller 56 is adjustable. Roller 56 is biased by voltage source 57 to a voltage level $V_D$.

The electrostatic latent image attracts the toner particles from the carrier granules forming a toner powder image on photoconductive surface 12. The detailed structure of the magnetic brush development system is more fully disclosed in U.S. Pat. No. 4,397,264, whose contents are hereby incorporated by reference.

As successive latent images are developed, toner particles are depleted from the developer material. A toner particle dispenser, indicated generally by the reference numeral 60 provides additional toner particles to housing 58 for subsequent use by developer roller 56. Toner dispenser 60 includes a container for storing a supply of toner particles therein and means (not shown) for introducing the particles into developer housing 58. A motor 62, when energized, initiates the operation of dispenser 60.

Infrared densitometer 64, positioned adjacent belt 10 and located between developer station C and transfer station D, directs infrared light onto surface 12 upon appropriate signals from the controller 31. The ratio of reflected light on a developed area to that of a bare area is an indication of toner patch developability. The densitometer generates output signals and sends them to controller 31 through appropriate conversion circuitry. The controller operates upon these signals and sends appropriate output signals to motor 62 to control dispensing of toner particles. Densitometer 64 is also used to periodically measure the light rays reflected from the bare photoconductive surface (i.e. without developed toner particles) to provide a reference level for calculation of the signal ratios.

Continuing with the system description, an output copy sheet 66 taken from a supply tray 67, is moved into contact with the toner powder image at transfer station D. The support material is conveyed to station D by a pair of feed rollers 68, 70. Transfer station D includes a corona generating device 71 which sprays ions onto the backside of sheet 66, thereby attracting the toner powder image from surface 12 to sheet 66. After transfer, the sheet advances to fusing station E where a fusing roller assembly 72 affixes the transferred powder image. After fusing, sheet 66 advances to an output tray (not shown) for subsequent removal by the operator.

After the sheet of support material is separated from belt 10, the residual toner particles and the toner particles of developed test patch areas are removed at cleaning station F.

Subsequent to cleaning, a discharge lamp, not shown, floods surface 12 with light to dissipate any residual charge remaining thereon prior to the charging thereof for the next imaging cycle.

It is believed that the foregoing description is sufficient for purposes of the present application to illustrate the general operation of an electrophotographic printing machine incorporating the main feature of the present invention therein, e.g. the generation of multiple exposure levels (test patches) using the system optics assembly 36. The function of the optical system is more fully described in the following description of operation in the automatic setup mode.

Figure 3:
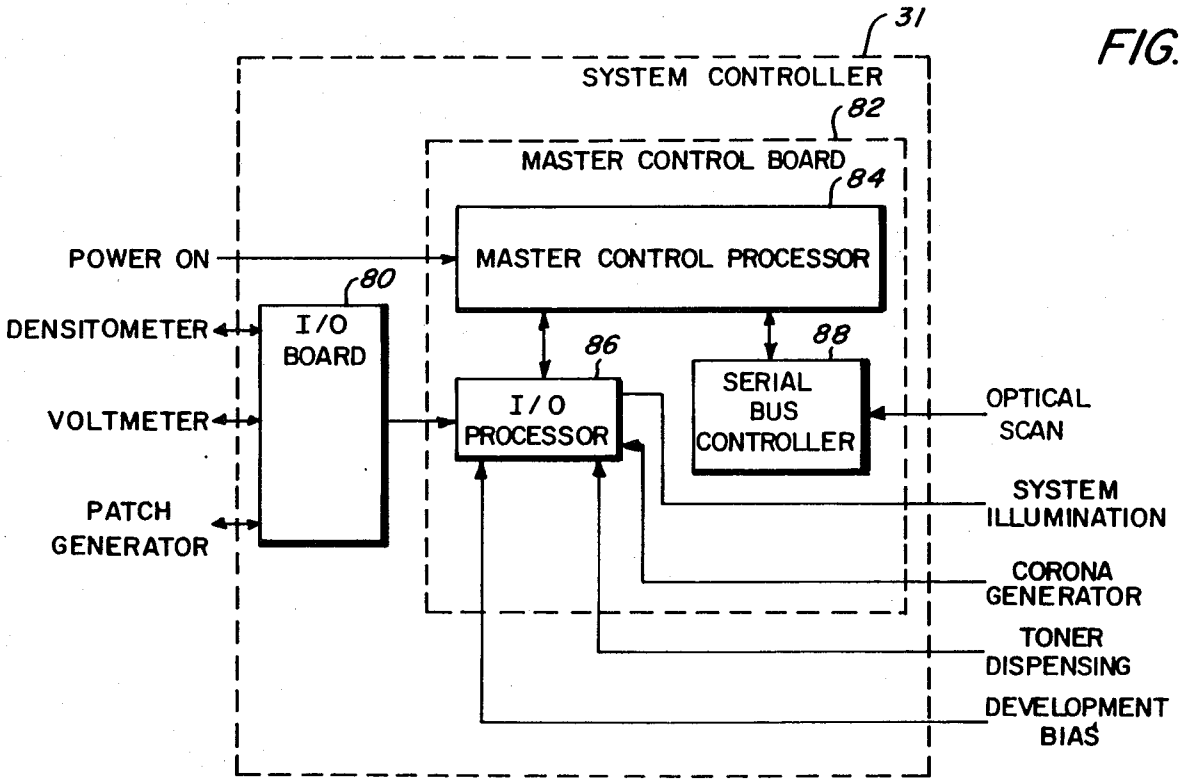
FIG. 3 is a block diagram of the system controller.

Upon initial installation of a particular electrophotographic printing machine and periodically (daily) thereafter, the basic machine parameters are automatically checked and adjusted. Each machine is associated with the same development potentials ($V_I - V_D$) by adjustment of the shape of the photo-induced discharge curve (PIDC) which has previously been determined to ensure uniform output copy quality across the machine population. A PIDC is a fundamental characteristic of a photoreceptor that has been charged to a specific dark potential $V_O$ in combination with the reflective density of the input document and the document illumination intensity. But any given population of photoreceptors will have a distribution of shapes. FIG. 2 shows a typical plot for a machine with the range of values indicated. Digital values representing the PIDC slope are contained within controller 31 memory of each machine. The setup mode and associated apparatus is designed to measure the basic parameters of the particular machine and plot the PIDC, based on these measured values. Insofar as the actual PIDC shape varies from the standard, adjustments are made to the basic parameters of charge voltage $I_C$, developer bias $V_{BIAS}$ and system exposure $E_O$ in an iterative process, until convergence of the measured, with the preset, values is realized. These basic control circuit subsystems which accomplish these operations are shown in FIG. 3. Referring to this Figure, controller 31 consists of Input/Output Board 80, and master control board 82, Input/Output processor 86 and a serial bus controller 88. Input signals from the densitometer 64, voltmeter 52 and patch generator 53 are converted by I/O board 80; sent to I/O processor 86 and then to processor 84. Output signals are sent to adjust the corona generator, system illumination, toner dispenser and development bias via processor 86. Operation of the optical scanning system is controlled by processor 84 via controller 88.

The master control processor is an Intel Model 8085 which can be programmed to perform the described iterative functions, using the algorithms set forth in the Appendix. Incorporation of these algorithms into a larger and central unit is a procedure well understood by those skilled in the art.

The automatic setup mode is initiated by applying initial power application to the machine. The sequence of operations occurring thereafter is shown with reference to FIGS. 4*a*, 4*b*.

FIGS. 4*a*, 4*b* is a flow chart sequence of these operations. FIG. 5 is a side view schematic drawing of the scan carriage at different density path generating positions. FIG. 6 is a time vs. voltage plot of the test patch generation sequence, and FIG. 7 is a top view of belt 10 showing the imaged patch zones. FIG. 9 is a flow chart of the test patch generator and machine functions. Referring to FIGS. 4*a*, 5, and 6, once machine power is turned on, the photoreceptor moves through a first cycle of operation at the system process speed. Scan carriage 45 moves to the home park position. Carriage 45, in this position is shown to the left of the platen in FIG. 5. The components are shown dotted. Scan lamp 42 is energized at the normal lamp power level used during the preceding operational interval. An opaque occluder 90 is positioned in the optical path at a point above the belt 10 surface, thus preventing light from falling on the surface in an area corresponding to the occluder. Thus a first test patch 100 shown formed on the belt centerline in FIG. 7 is therefore at the dark decay charging level $V_{DDP}$. Carriage 45 is then moved to the right, scanning at a constant velocity, until it reaches park position 1 past the end of scan position (shown in solid line in FIG. 5). At this position, a 0.3 density target strip 92 centrally overlies the scan carriage. At this point, lamp 42 output is doubled so as to form a second patch area 102 conforming in size to strip 92 representing a 100% transmission, completely discharged strip at background voltage level, $V_{BG}$.

With carriage 45 still in the solid line position shown in FIG. 5, the lamp illumination input is halved. Thus, and according to one of the features of the present invention, the 0.3 test patch, in conjunction with changes in the illumination level, provides two separate density level outputs. The exposed patch area 104 on belt 10 forms a 0.3 density patch 104 on the photoreceptor. Carriage 45 is then returned to the home position and a second $V_{DDP}$ patch 106 is formed on the center line of belt 10.

Further operation of the carriage is dependent upon whether PIDC convergence is present as determined by comparisons of voltmeter-generated signals processed by the microprocessor 84 and compared to values stored in the microprocessor memory.

Electrostatic voltmeter 52, shown in FIG. 1, is used to directly sense photoreceptor voltage at the test patch areas 100, 102, 104, 106. The voltmeter is positioned approximately 3 mm from the belt surface.

FIG. 4*b* shows the functional flow diagram for the voltmeter readings and the related microprocessor control operation. Referring to this figure, and to FIG. 6, the voltmeter measures each of test patch charge levels on successive belt cycles. Signals representing the voltage at patch 100 ($V_{DDP}$), patch 102 ($V_{BG}$) and patch 104 ($V_{0.3D}$) are sent to the control processor 84 through the associated I/O circuitry and temporarily stored therein. The difference between $V_{DDP}$ and $V_{BG}$ is computed by logic means within the controller and a signal, representing this value and designated constant contrast voltage ($V_C$) is generated. This signal is compared to a preset $V_{CSET}$ ($V_S$). If $V_C \neq V_S$, (no convergence), a signal is generated within the processor and sent to change the bias ($V_{GRID}$) on the charge electrode 24 (FIG. 1) thereby changing the value of charge current $I_C$ and the value of $V_{DDP}$. Signals are also sent to patch generator 53 to erase the previously generated patch areas. Scan carriage 45 then repeats the sequence described with respect to FIGS. 4*a* and 5, beginning at the home park position and continuing to park position 2. The newly formed patches are again read by the voltmeter and compared by processor 84 (FIG. 4*b*). This process is an iterative one governed by a control algorithm set forth in the Appendix; the process is continued until the measured value of $V_C$ conforms to $V_S$. At this point, the value of $V_{DDP}$ and $V_{BG}$ conforms to the PIDC for the machine. These values, as well as $V_S$, $V_D$ and $V_{BIAS}$ are stored in the processor memory.

A second iterative process is controlled by logic means within processor 84, which compares the measured values of the $V_{0.30}$ patch to a preset $V_{0.3DS}$ value. System illumination is varied to achieve identity of the set and measured values; convergence establishes a third point on the PIDC. As shown in FIG. 8, processor 84 measures the difference between the test value of $V_{0.3D}$ and the $V_{0.3DS}$, set into the processor memory. If $V_{0.30} \neq V_{0.3DS}$ (no convergence) processor 84 sends a signal to lamp power supply 51 to vary the output of lamp 42 and to patch generator 53 to erase the $V_{0.3D}$ patch 104. Scan carriage 45 repeats the process beginning at the home position 1 and the voltmeter again measures the charge at patch 104 sending the output signal to the processor. This iterative process is controlled by a second algorithm provided in the Appendix.

Upon convergence of $V_{0.3D}$ and $V_{0.3DS}$, the value of $E_O$, system exposure level, is stored. Convergence has assured that the 0.3D voltage also falls on the PIDC curve shown in FIG. 2. Thus, the charge at the high ($V_{DDP}$), low ($V_{BG}$) and intermittent levels all lie along the predetermined PIDC, thus ensuring that the copy quality will be consistent with machine population utilizing that particular PIDC.

To summarize the automatic setup procedure to this point, the basic xerographic parameters of charge current, illumination level and the developer bias have been set. The remainder of the setup procedure is directed to the calibration of the patch generator based on these values and the adjustment, if necessary, of toner concentration. FIG. 9 shows a functional flow diagram setting forth these steps.

Referring to FIGS. 5 and 9, and to the timing diagram shown in FIG. 10, scan carriage 45 is moved to the right, past park position 1 to park position 2 where it is parked directly beneath a centrally located 0.7 density target strip 107. A 0.7 patch 108 (FIG. 11) is thus formed along the centerline of belt 10 conforming in area to strip 107. The carriage then returns to the home position where a $V_{DDP}$ patch 110 is formed. As patch 110 passes beneath densitometer 64, the patch is illuminated by a light output from the generator determined by the bias voltage $V_{PG}$ applied to the patch generator. The charge level at patch 110 is therefore reduced to level $V_{DPG}$ which is lower than $V_{0.7D}$.

Both patches 108 and 110 are developed at development station C (FIG. 1) and pass beneath densitometer 64. As illustrated in FIG. 1 and FIG. 11, the densitometer detects the density of the developed test area and produces electrical output signals indicative thereof. Thus the densitometer produces output signals proportional to the toner mass deposited on the $V_{0.7D}$ patch 108 and the $V_{DPG}$ patch 110. These signals are conveyed to processor 84 through conversion circuitry shown in FIG. 3. Processor 83 compares the two values and if there is a difference ($V_{DSS}$) a signal is generated which changes the voltage level at the patch generator. The developed patches are cleaned at cleaning station F, FIG. 1, and patches 108 and 110 are laid down as previously described, developed and again measured by densitometer 64. Adjustments are made to patch generator 53 in an iterative process governed by the algorithm set forth in the Appendix until the two measured values are equal. When this occurs, the patch generator is properly calibrated to the system parameters and value representing $V_{PG}$ is stored.

The final task of the setup procedure is to adjust the developer parameters, if necessary. An adjustment may not be necessary since the toner concentration level is monitored during normal operation and toner periodically added, as is known in the art. Therefore, a previous operation cycle should have left the toner concentration in a proper operating condition. However, the present setup procedure ensures proper toner concentrations by comparing the last $V_{DDS}$ value measured and stored by processor 84 with a previously stored $V_{DSS}$ value representing a value of $V_{DSS}$ which if exceeded, indicates a low level of toner concentration is present. As shown in FIG. 9, if the difference between the two exceeds a set value, processor 84 activates toner dispenser motor 63 causing toner dispenser 60 to discharge toner particles into toner container 62. This increases the concentration of toner particles in the developer mixture so as to increase the density of subsequent developed test patches. Carriage 45 forms a subsequent $V_{0.70}$, $V_{DDP}$ patch. Densitometer 64 measures the respective density and processor 82 determines a new $V_{DSS}$ value as described above. The new $V_{DSS}$ is compared with the $V_{DSS}$ set, the process repeated, if necessary. Once the values are within the predefined difference range, toner developability parameters have been defined and the automatic setup procedure is terminated. Normal machine operation then begins and the optical system components perform in their normal document scanning functions.

It is thus apparent that the optical illumination and scanning system of the present invention performs test patch generation functions which support sophisticated test and control techniques. The ability to sequentially form test patches of varying densities in an iterative fashion enables very accurate setting of system parameters.

While the invention has been described in conjunction with a specific embodiment thereof, it is evident that many alternatives, modifications and variations will be apparent to those skilled in the art. For example, while the present example of a setup procedure requires an iterative process, certain systems may require a single series of test patches to be generated.

APPENDIX

Controller Algorithms (#1) The grid bias control voltage adjustment for contrast setup is as follows:

$$v_{grid}(n+1) = v_{grid}(n) + \{\{0.C(v_{cntrstset} - v_{cntrst})\}\}$$

(#2) The grid bias additive adjustments for the Pictorial Copy modes ($P_{mode}$) are determined as follows:

$$v_{grid}\text{add}(P_{mode}) = \{k_1(f_{ddp}(P_{mode}))\}$$

(#3) The $V_{ddp}$ setpoint for the pictorial modes is as follows:

$$v_{ddp}(P_{mode}) = v_{ddpsu} + f_{ddp}(P_{mode})$$

Where $f_{ddp}$ for the above two algorithms is:

$$f_{ddp}(P_{mode}) = \left\{ \frac{F_{ddp}P_{mode}}{A_{esv}} \right\}$$

Where $A_{esv}$ is the digital resolution of the ESV input.

(#4) The following equation for developer bias can be used for determining the required bias during ABS (autosetup and customer access mode) as well as for determining $V_{biassu}$:

$$V_{bias} = v_{bg} + v\text{bias}_{clnfld}$$

The term $v_{bg}$ is replaced with $v_{absmin}$ during any ABS adjustment and replaced with $v_{P11}$ during the $V_{biassu}$ calculation.

The term $v\text{bias}_{clnfld}$ is the cleaning field in terms of developer bias. There is a value for each of the nomral copy modes. During setup the value is for CN.

$$v\text{bias}_{clnfld}(\text{Mode}) = \left\{ \frac{F_{clean}(\text{Mode})}{G_{db}} \right\}$$

The particular mode is found in the Table "Multinational Standard Modes" at the end of the Appendix.

(#5) The illumination control voltage adjustment for the exposure setup is expressed in terms of bit count as follows:

$$E_O(n+1) = E_O(n) + \{\{k_2(v_{0.3cont} - c_{0.3contset})\}\}$$

(#6) The pre-developability patch generator adjustment is as follows:

$$v_{pgen} = v_{pgen} + (k_3 \Delta v_{dpp} - \Delta v_{bias})$$

(#7) For the patch generator setup, if the error in the DSS readings is greater than 3 bits and the number of iterations is less than 3 (cycles is less than 7), the correction applied is:

$$v_{pgen}(n+1) = v_{pgen}(n) + \{k_4(dss_{p21}(\text{ave}) - dss_{PO}(n)\}$$

(#8) The final adjustment to the patch generator level is as follows:

$$V_{pgen}(n+1) = V_{pgen}(n) + \{k_4(v_{0.7average} - (v_{bg} + v_{clnfld}) - v_{0.7devset})\}$$

(#9) The developer bias setpoint for the copy modes is as follows:

$$v_{bias}(\text{Mode}) = v_{biassu} + f_{bias}(\text{Mode})$$

Where $f_{bias}$ is:

$$f_{bias}(\text{Mode}) = \left\{ \frac{F_{bias}(\text{Mode})}{G_{db}} \right\}$$

Multinational Standard Modes

| Mode | $F_{exp}$ | $F_{bias}$ (v) | $F_{ddp}$ (v) | $F_{pgen}$ | $F_{clean}$ (v) |
|---|---|---|---|---|---|
| CL4 | 1.4 | +45 | 0 | 0.76 | +160 |
| CL3 | 1.4 | +10 | 0 | 0.95 | +125 |
| CL2 | 1.29 | 0 | 0 | 1.0 | +105 |
| CL1 | 1.14 | 0 | 0 | 1.0 | +90 |
| CN | 1.00 | 0 | 0 | 1.0 | +65 |
| CD1 | 0.89 | 0 | 0 | 1.0 | +50 |
| CD2 | 0.79 | 0 | 0 | 1.0 | +20 |
| CD3 | 0.75 | −10 | 0 | 1.06 | −5 |
| CD4 | 0.75 | −45 | 0 | 1.25 | −40 |

Pictoral Modes

| Mode | $F_{exp}$ | $F_{bias}$ | $F_{ddp}$ | $F_{pgen}$ | $F_{clean}$ |
|---|---|---|---|---|---|
| PL4 | 1.32 | −135 | −345 | 0.00 | +30 |
| PL3 | 0.93 | −150 | −360 | 0.00 | +5 |
| PL2 | 0.79 | −125 | −335 | 0.00 | +10 |
| PL1 | 0.71 | −95 | −295 | 0.03 | +25 |
| PN | 0.71 | −80 | −245 | 0.20 | +25 |
| PD1 | 0.71 | −65 | −190 | 0.40 | +15 |
| PD2 | 0.85 | −65 | −145 | 0.63 | +25 |
| PD3 | 1.00 | −65 | −100 | 0.86 | +40 |
| PD4 | 0.99 | −65 | −55 | 1.08 | +25 |

What is claimed is:

1. In an electrophotographic printing machine wherein a document on a support platen is scanned and an image thereof is projected onto a photoreceptor surface, an optical illumination and scanning system adapted to operate in a first and second mode of operation, said system comprising:

means for moving an illumination and scan assembly mounted beneath said platen in a first, document copying, mode from a start of scan to an end of scan to the start of scan position whereby a latent image of the document is formed on the photoreceptor surface, at least one density target strip affixed to the bottom surface of the platen at a location outside the end of scan position, said moving means adapted to move said illumination and scan assembly, in a second, test, mode of operation, to a first position outside the start of scan position, said motion occurring coincident with the positioning of an opaque occluder in the optical path to form a dark decay test patch at the photoreceptor surface, said moving means further adapted to move said illumination and scan assembly from said first position to a second position beneath said target strip, and means for selectively and sequentially altering the illumination level directed to said target strip to thereby form test patches of varying density at the photoreceptor surface.

2. The electrophotographic printing machine of claim 1 wherein the test patches are formed along the centerline of the photoreceptor.

* * * * *